US008490298B2

(12) United States Patent
Sato et al.

(10) Patent No.: US 8,490,298 B2
(45) **Date of Patent: *Jul. 23, 2013**

(54) UPPER STRUCTURE FOR A SHOE

(75) Inventors: Natsuki Sato, Kawanishi (JP); Tetsuo Yamamoto, Nishinomiya (JP)

(73) Assignee: Mizuno Corporation, Osaka-shi (JP)

( * ) Notice: Subject to any disclaimer, the term of this patent is extended or adjusted under 35 U.S.C. 154(b) by 35 days.

This patent is subject to a terminal disclaimer.

(21) Appl. No.: 13/240,384

(22) Filed: Sep. 22, 2011

(65) Prior Publication Data

US 2012/0023779 A1 Feb. 2, 2012

Related U.S. Application Data

(62) Division of application No. 11/982,218, filed on Oct. 31, 2007, now Pat. No. 8,056,264.

(30) Foreign Application Priority Data

Nov. 29, 2006 (JP) ..... 2006-321451

(51) Int. Cl.
*A43B 23/00* (2006.01)

(52) U.S. Cl.
USPC ..... 36/45; 36/114; 36/55; 36/51

(58) Field of Classification Search
USPC ..... 36/45, 51, 54, 55, 88, 114
See application file for complete search history.

(56) References Cited

U.S. PATENT DOCUMENTS

| | | | | |
|---|---|---|---|---|
| 1,660,203 | A | 2/1928 | Morgan | |
| 2,147,197 | A | 2/1939 | Glidden | |
| 5,430,959 | A | 7/1995 | Mitsui | |
| 5,566,475 | A | 10/1996 | Donnadieu | |
| 6,772,540 | B2 | 8/2004 | Delgorgue et al. | |
| 6,802,139 | B2 | 10/2004 | Pitts et al. | |
| 6,860,035 | B2 | 3/2005 | Girard | |
| 6,931,762 | B1 | 8/2005 | Dua | |
| 7,552,547 | B2 | 6/2009 | Calderone | |
| 8,056,264 | B2 * | 11/2011 | Sato et al. | 36/45 |
| 2004/0111921 | A1 | 6/2004 | Lenormand | |
| 2004/0128863 | A1 | 7/2004 | Hong et al. | |
| 2008/0120871 | A1 | 5/2008 | Sato et al. | |

FOREIGN PATENT DOCUMENTS

| | | |
|---|---|---|
| JP | 6-217806 | 8/1994 |

OTHER PUBLICATIONS

Office Action in U.S. Appl. No. 11/982,218, mailed Feb. 4, 2011, 6 pages, USPTO, Alexandria, VA, USA.

* cited by examiner

*Primary Examiner* — Marie Patterson
(74) *Attorney, Agent, or Firm* — W. F. Fasse

(57) ABSTRACT

An upper structure for a shoe includes an upper body and an outside upper member that overlaps the lateral side of the upper body to cover the foot's talus and that has a bottom edge portion fixedly attached to a bottom surface of the upper body. A rear end portion of the bottom edge portion is located rearwardly of the calcaneus load centerline. A rear edge portion of the outside upper member is separate from the upper body rearwardly of the talus. An instep edge portion of the outside upper member is connected to the shoelace. The upper structure includes a region that is expandable and contractible in a longitudinal direction. A top end of the region extends to the opening of the upper body, and a bottom end of the region is disposed in front of the calcaneus load centerline and below 55% of the foot's lateral ankle height.

28 Claims, 11 Drawing Sheets lateral side

UPPER STRUCTURE FOR A SHOE

CROSS-REFERENCE TO RELATED APPLICATION

This application is a Divisional and claims the benefit under 35 USC 120 and 121 of U.S. application Ser. No. 11/982,218 filed on Oct. 31, 2007, issue as U.S. Pat. No. 8,056,264 on Nov. 15, 2011, the entire disclosure of which is incorporated herein by reference.

BACKGROUND OF THE INVENTION

The present invention relates to an upper structure for a shoe, and more particularly, to an improvement in the structure for enhancing a fit of a heel portion of the shoe during heel contact of the shoe with the ground to the push off motion of the foot.

A shoe is generally composed of a sole, an upper that is fixedly attached on the sole and that covers a foot of a shoe wearer, and a fastening member such as a shoelace that fastens the upper around the foot.

Recently, in a running shoe, high-grade cushioning properties and ride feelings during running are required and thus at the time of deformation of the sole moderate elastic elongation is necessary on the top surface of the sole.

In such a running shoe, when the shoe strikes onto the ground from the heel portion, in accordance with elongation of the sole top surface the bottom surface of the upper is also going to elongate in the longitudinal direction. As a result, the top portion of the upper is going to contract in the longitudinal direction. However, since the upper top portion in the prior-art shoe cannot contract in the longitudinal direction, the upper top portion is going to extend in the lateral direction thus causing a slack in the opening of the shoe. The result is that the opening of the shoe opens widely at the time of heel contact with the ground and a fit of the heel portion of the shoe relative to the foot heel portion decreases, which comes into question.

On the other hand, Japanese patent application publication No. 6-217806 (hereinafter called JP reference 6-217806) shows a shoe that is composed of a sole, an inside upper fixedly attached to the sole and receiving a foot of a shoe wearer, and a first and second strap extending along the outside of the inside upper on the medial and lateral side of the shoe. An end of the first and second strap is fixedly attached to the sole through a hole formed at the top portion of the heel rear end of the shoe and the other end of the first and second strap is connected to a shoelace.

In this case, by fastening the first and second strap via the shoelace, the opening of the inside upper of the shoe tightly contacts an ankle of the foot to increase a fit of the shoe.

In the shoe shown in JP reference 6-217806, it is possible in a degree to prevent the opening of the inside upper from opening at the time of heel contact with the ground by fastening the first and second strap extending around the opening of the inside upper. However, fastening of the first and second strap may hinder a free motion of the ankle.

The present invention has been made in view of these circumstances and an object of the present invention is to provide an upper structure for a shoe that can improve a fit of the heel portion of the shoe during the heel contact with the ground to the push off motion of the foot without hindering the free motion of the ankle.

SUMMARY OF THE INVENTION

An upper structure for a shoe according to the present invention includes an upper body that has a bottom surface fixedly attached to a sole of the shoe and that covers a foot of a shoe wearer, and an outside upper member that overlaps the outside of the upper body on either or both the lateral side or the medial side of the shoe, that has an instep side edge portion extending to an instep portion of the upper body, and whose bottom side edge portion is fixedly attached to the bottom surface of the upper body. The rear end of the bottom side edge portion of the outside upper member is located at the rear of the load centerline of the calcaneus of the foot. The rear side edge portion of the outside upper member is provided separately from the upper body at the rear of the talus of the foot, and the outside upper member covers the talus. The instep side edge portion of the outside upper member is connected to a fastening member of the shoe. The heel portion of the upper body has a region that is extendable and contractible in the longitudinal direction on either or both the lateral side or the medial side. The top end of the region extends to an opening of the upper body, and the bottom end of the region is disposed in front of the load centerline of the calcaneus of the foot and below the height corresponding to 55% of the medial ankle height or the lateral ankle height.

According to the present invention, when wearing the shoe, by fastening the fastening member, the upper body presses against the calcaneus and talus of the foot via the outside upper member. Thereby, the heel portion of the foot can be held securely and thus a fit of the upper structure relative to the heel portion can be secured.

When the shoe strikes onto the ground on the heel portion, in accordance with deformation of the sole heel portion, the bottom portion of the upper body is going to elongate in the longitudinal direction and the top portion of the upper body is going to contract in the longitudinal direction. At this juncture, since there is provided the longitudinally extendable and contractible region extending to the opening of the shoe on the lateral and/or medial side of the heel portion of the upper body, the top portion of the upper body can contract in the longitudinal direction thereby preventing the top portion of the upper body from elongating in the lateral direction and thus preventing the opening of the shoe from causing a slack. As a result, when the shoe impacts the ground on the heel portion, the opening of the shoe will not open widely thus improving a fit of the heel portion of the shoe relative to the heel portion of the foot.

In this case, since the bottom end of the expandable and contractible region is disposed in front of the load centerline of the calcaneus of the foot, when the shoe impacts the ground on the heel portion a fit of the upper body relative to the heel portion of the foot will not be hindered by the expandable and contractible region and thus a fit relative to the heel portion can be maintained. Also, in this case, since the bottom end of the expandable and contractible region is located below the height corresponding to 55% of the lateral ankle height or the medial ankle height of the foot, an adequate area for the region to expand and contract in the longitudinal direction can be secured in the upper body. Thereby, when the shoe impacts the ground on the heel portion, a large slack can be prevented from occurring at the opening of the top portion of the upper body.

FIG. 4 depicts an example in which the expandable and contractible region is provided on the lateral side of the upper body. In FIG. 4, point Kc designates the most projecting point of the lateral ankle of the foot, and point H designates the lateral ankle height, i.e. the height from the bottom surface of the upper body to the most projecting point Kc. Point B designates the bottom end of the expandable and contractible region 10 and dash-and-dot line C designates the load centerline of the calcaneus of the foot. Measurement h designates the height corresponding to 55% of the lateral ankle height of the foot.

As shown in FIG. 4, the bottom end B of the expandable and contractible region 10 is located in front of the load centerline C of the calcaneus of the foot. Thereby, the upper body can secure enough areas for holding the calcaneus of the foot at the time of heel contact with the ground and thus a fit of the upper body relative to the heel portion of the foot can be maintained.

In the case where the bottom end B of the expandable and contractible region 10 is located above the height h corresponding to 55% of the lateral height H of the foot, as can be seen from FIG. 4, the opening portion of the upper body 30 can hardly secure areas for the expandable and contractible region 10 and as a result the expandable and contractible region 10 can hardly display an expanding and contracting action at the time of heel contact with the ground. To the contrary, in the case where the bottom end B of the expandable and contractible region 10 is located below the height h corresponding to 55% of the lateral height H of the foot as mentioned above, the expandable and contractible region 10 can secure enough areas for expanding and contracting in the longitudinal direction at the time of heel contact with the ground and the opening portion of the top portion of the upper body 30 can thus be prevented from opening.

Then, during the foot-flat moment (i.e. the moment of contact of the entire sole surface with the ground) to the push-off motion of the foot, the load moves toward the front side (i.e. the toe side). At this juncture, a press of the outside upper member due to fastening of the shoe lace presses the upper body against the calcaneus and talus of the foot thus preventing the foot from moving forwardly and a fit relative to the heel portion of the foot can be maintained. Moreover, in this case, the outside upper member will not fasten the ankle of the shoe wearer excessively tight and a free motion of the ankle will not be hindered during running.

According to the present invention, the upper heel portion has a two-layer structure formed of the upper body (or inside layer) and the outside upper member (or outside layer) and the upper body and the outside upper member function independently from each other, that is, at the time of heel contact with the ground the upper body acts to prevent the opening portion from opening and during the foot-flat moment to the push-off motion of the foot the outside upper member acts to prevent the foot from moving forwardly. Thereby, during the time of the heel contact with the ground to the push-off motion of the foot a fit of the heel portion of the shoe can be improved without impeding the free motion of the ankle.

The expandable and contractible region and the outside upper member may be located on the lateral side or the medial side of the shoe. When the outside upper member is disposed overlapping with the upper body on the lateral side of the shoe, supportability of the heel lateral portion can be enhanced and an upper structure can thus be achieved suitable for an athlete who habitually impacts the ground on the heel lateral side of the shoe. When the outside upper member is disposed overlapping with the upper body on the medial side of the shoe, supportability of the heel medial portion can be enhanced and an upper structure can thus be achieved suitable for an athlete who habitually impacts the ground on the heel medial side of the shoe.

Preferably, the load centerline of the calcaneus is located at the position of 0.17 L from the heel rear end of the shoe, where L designates a size of the shoe (or foot length of a shoe wearer). Also, preferably, the bottom end of the expandable and contractible region is located below the height corresponding to 0.15 L from the bottom surface of the upper body. The expandable and contractible region may be inverted-triangular in shape.

Preferably, when the shoe is in wear, the expandable and contractible region of the upper body is elastically elongated. In this case, when the top portion of the upper body is going to contract in the longitudinal direction at the time of heel contact with the ground, the expandable and contractible region of the upper body can easily contract because resilient force to restore the original state has been acting on the region of the upper body, thus securely preventing the opening portion of the top portion of the upper body from opening.

The upper body may have a tongue portion at the instep portion of the shoe and the tongue portion may be connected to the upper body via the expandable and contractible member. In this case, action of the resilient force of the expandable and contractible member further securely prevents the opening portion of the top portion of the upper body from opening.

The rigidity of the upper body may be greater than that of the outside upper member. In this case, an upper structure can be achieved in which supportability of the upper body relative to the foot is enhanced.

Alternatively, the rigidity of the outside upper member may be greater than that of the upper body. That is, the rigidity of the upper body may be smaller than that of the outside upper member. In this case, an upper structure can be achieved in which follow-up abilities of the upper body relative to the foot is enhanced. Also, in this case, wear feeling of the shoe relative to the foot at a standstill can be improved.

The shoe may have a heel counter member at the heel portion to improve supportability of the heel portion and in this case the expandable and contractible member of the upper body does not overlap with the heel counter member. Thereby, the expandable and contractible member of the upper body does not impede the action of the heel counter member.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 4:
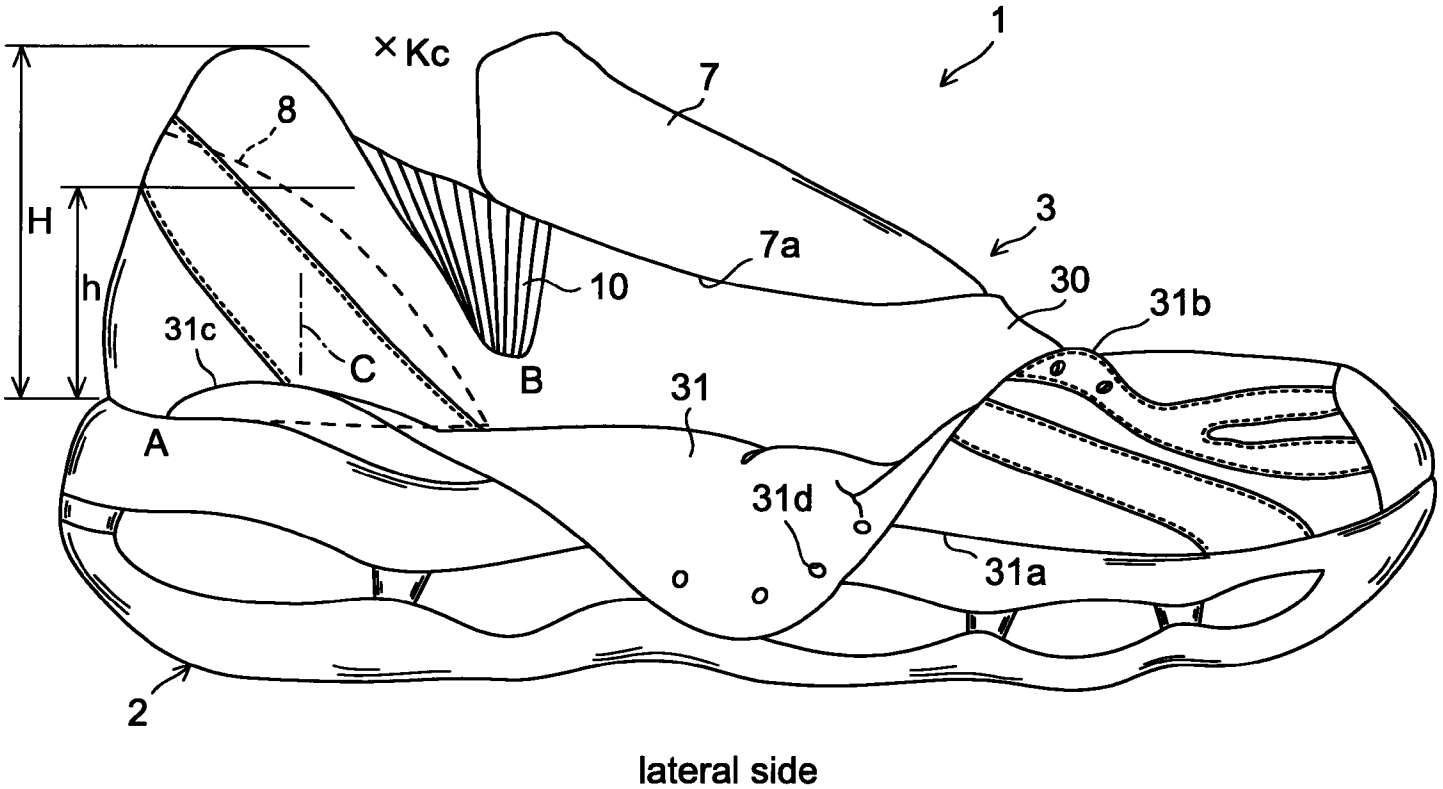
FIG. 4 is a lateral side view of the shoe in the state where a lateral side upper member is open outside.
Figure 5:
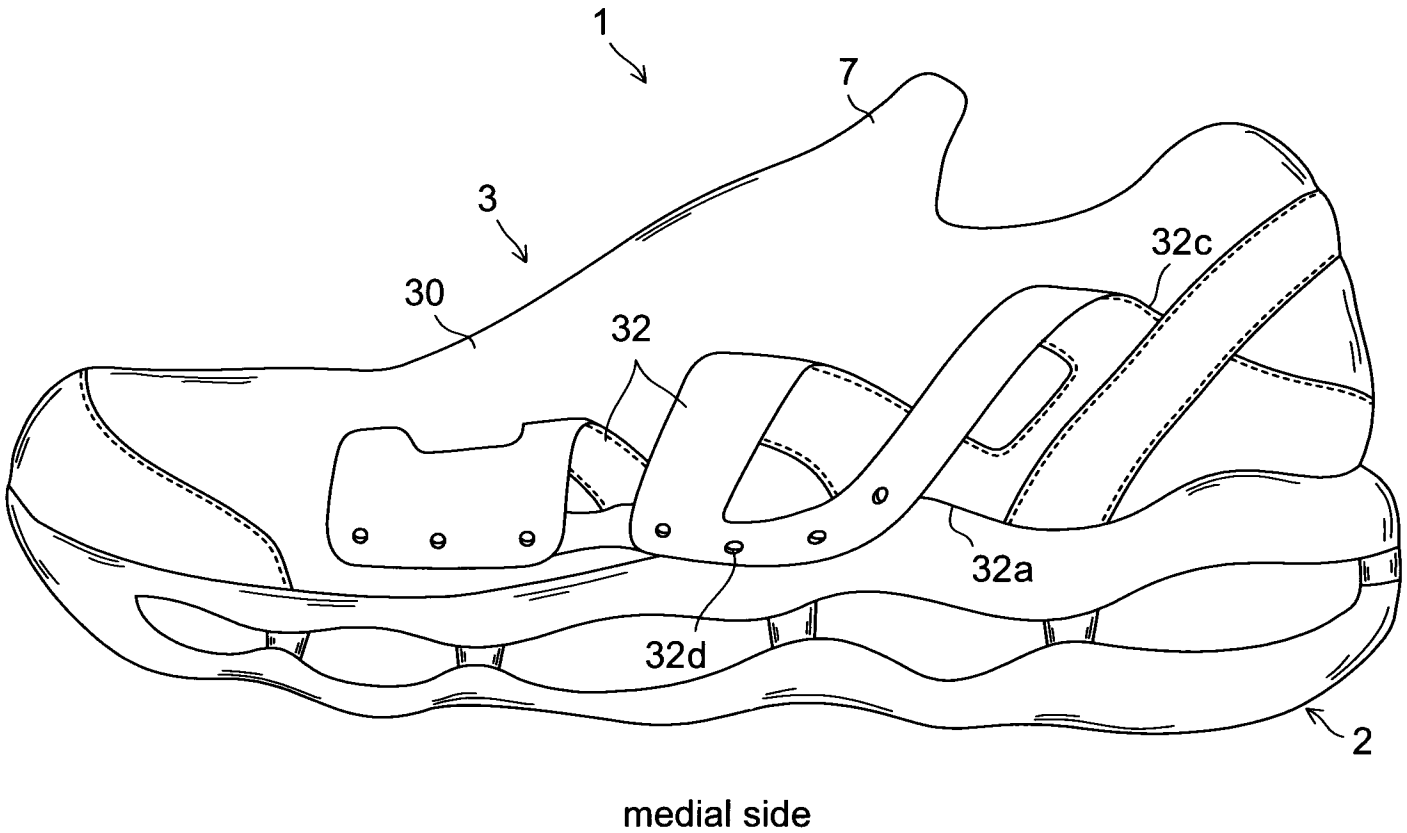
FIG. 5 is a medial side view of the shoe of FIG. 4.
Figure 6:
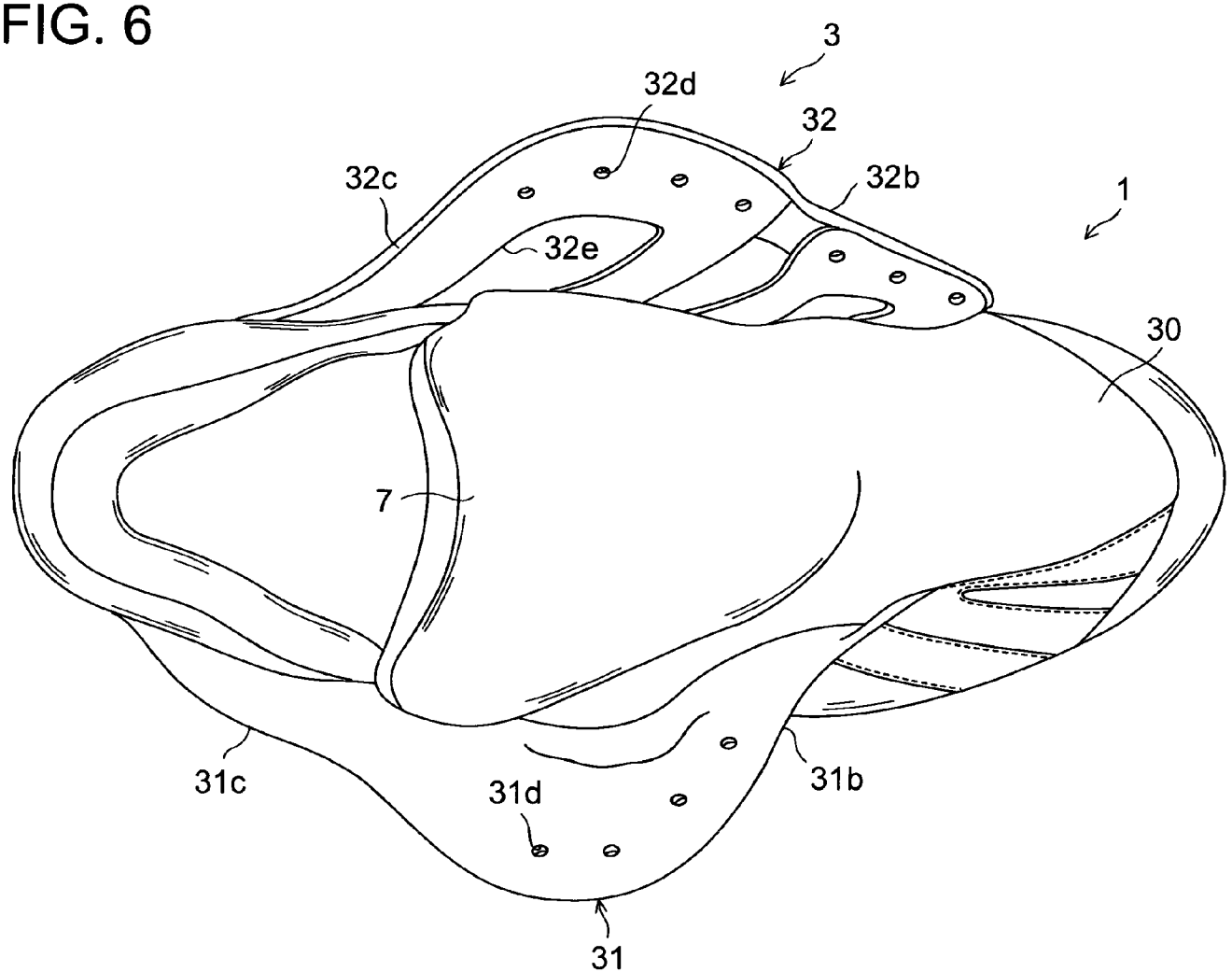
FIG. 6 is a top plan view of the shoe of FIG. 4.

Referring now to the drawings, FIGS. 1 to 6 illustrate an upper structure for a shoe according to an embodiment of the present invention. In FIGS. 4 to 6, shoelaces are removed for illustration purposes.

As shown in FIGS. 1 to 6, a shoe 1 is composed of a sole 2, and an upper assembly 3 fixedly attached on the top surface of the sole 2. The upper assembly 3 includes an upper body 30 provided inside the upper assembly 3 and covering a shoe wearer's foot, and an outside upper member 31 overlapping with the outside of the upper body 30 on the lateral side of the shoe 1.

The upper body 30 extends from the heel region through the midfoot region to the forefoot region of the shoe 1, and covers the heel portion, lateral and medial sides, and instep portion of the foot. The bottom surface of the upper body 30 is fixedly attached to the top surface of the sole 2.

The outside upper member 31 has an area that defines a bottom side edge portion 31*a* fixedly attached to the sole 1 on the bottom surface of the upper body 30, an instep side edge portion 31*b* provided at the instep portion of the upper body 30 and whose front end side portion is fixedly attached to the upper body 30, and a rear side edge portion 31*c* extending diagonally upwardly from the rear end A of the bottom side edge portion 31*a* to the top portion of the instep portion. The outside upper member 31 is separated from the upper body 30 except the bottom side edge portion 31*a* and the front side portion of the instep side edge portion 31*b* (see FIG. 4).

Figure 1:
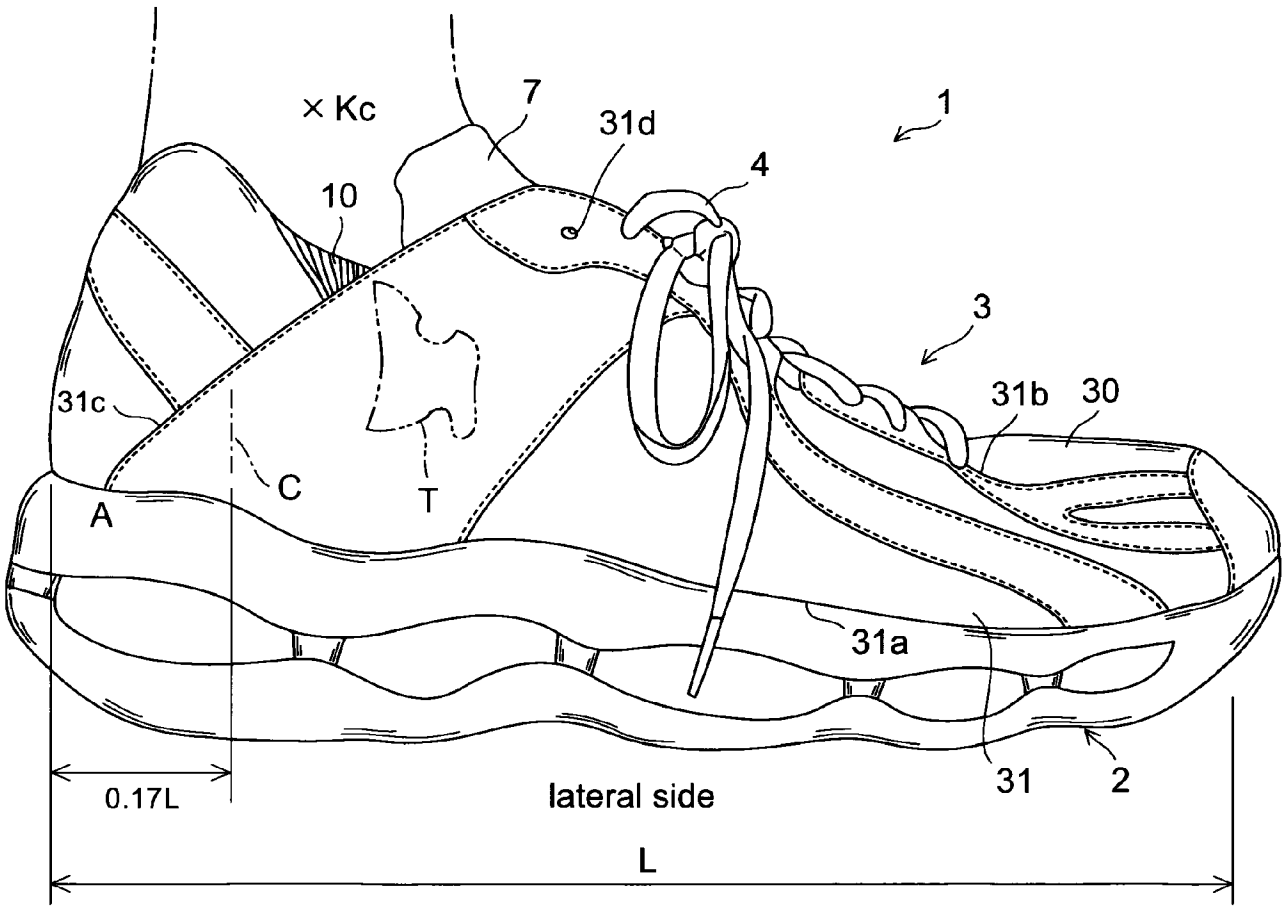
FIG. 1 is a lateral side view of the shoe employing the upper structure according to an embodiment of the present invention.

The rear end A of the bottom side edge portion 31*a* of the outside upper member 31 is located at the rear of the load centerline C of the calcaneus of the shoe wearer's foot (see FIGS. 1 and 4). In other words, the load centerline C of the calcaneus is located at the position of 0.17 L from the heel rear end of the shoe, where L designates the foot length or the size of the shoe. In the actual shoe, since there is provided a longitudinal play of approximately 1-1.5 cm relative to the foot length, as shown in FIG. 1, the front end position of the foot length L is disposed before the tip end of the toe portion of the shoe. The outside upper member 31 covers the talus T of the foot. The instep side edge portion 31*b* of the outside upper member 31 has an eyelet hole 31*d* formed therein to insert the shoelace 4 as a fastening member of the shoe 1.

Figure 2:
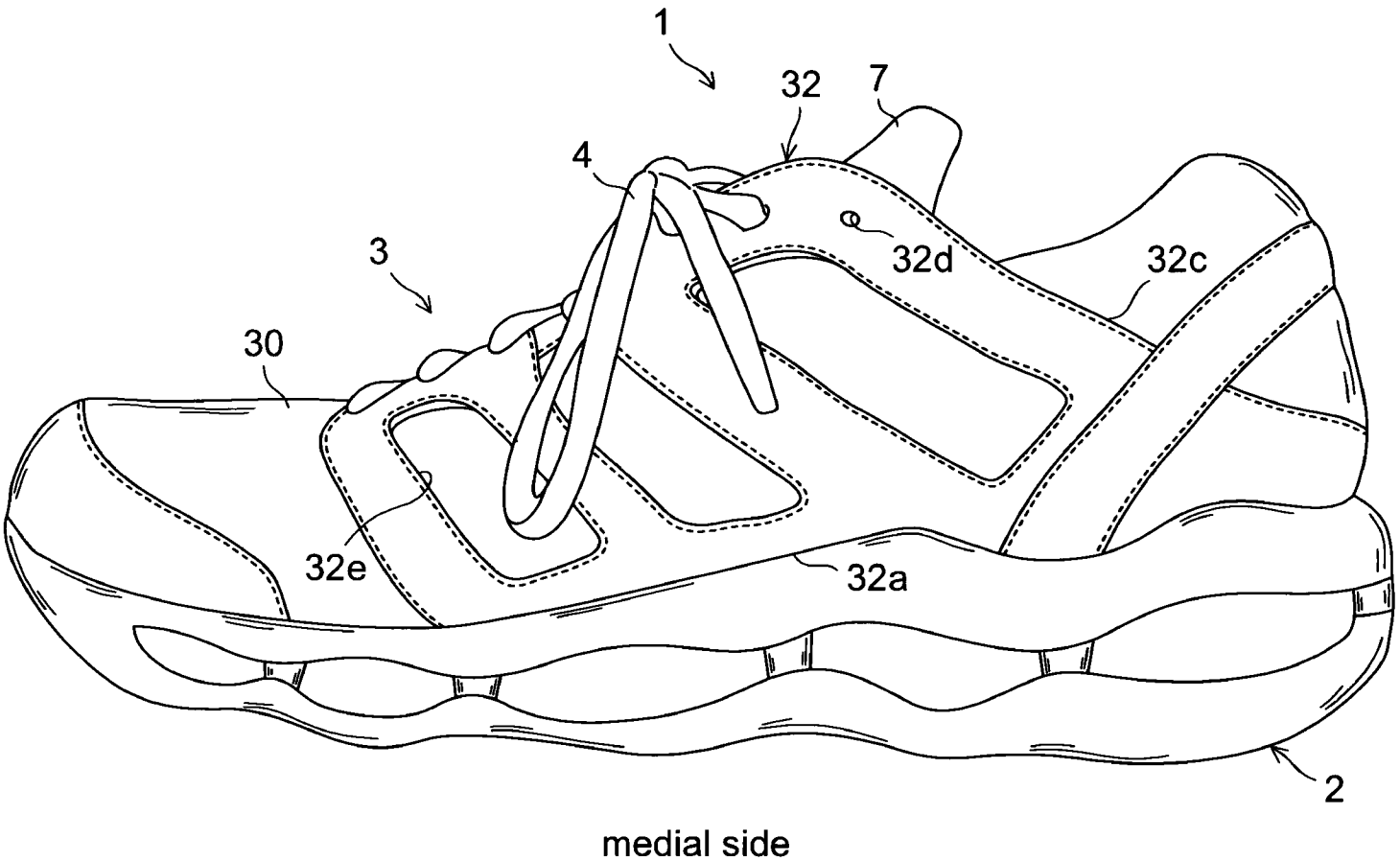
FIG. 2 is a medial side view of the shoe of FIG. 1.
Figure 3:
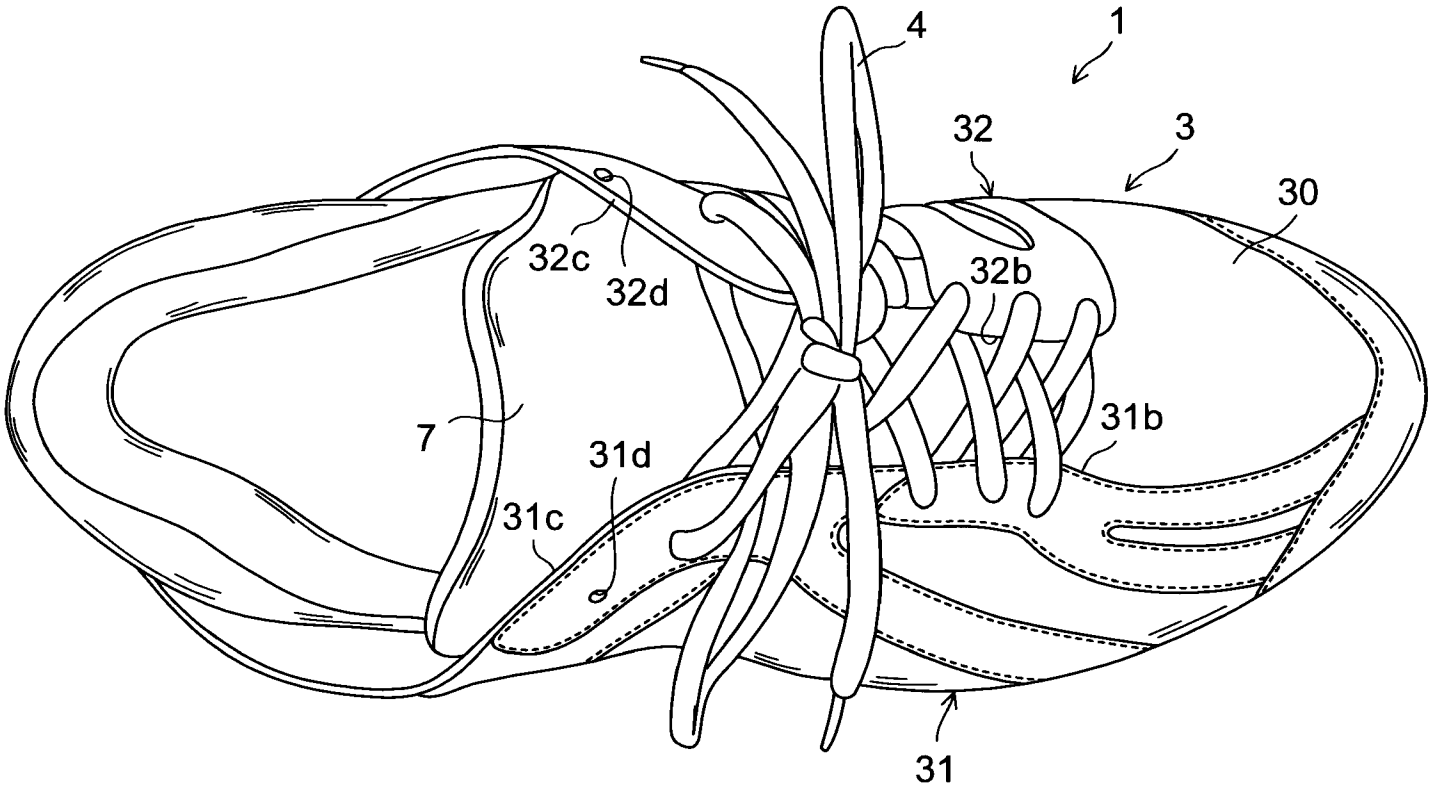
FIG. 3 is a top plan view of the shoe of FIG. 1.

A belt member 32 is provided outside the upper body 30 on the medial side of the shoe 1 (see FIGS. 2 and 5). The belt member 32 is formed of a plurality of (e.g. four in this example) belts that are spaced apart from each other via a gap 32*e*. The bottom side edge portion 32*a* of the belt member 32 is fixedly attached to the bottom surface of the upper body 30. The rear side edge portion 32*c* extends diagonally upwardly from the heel region to the top portion of the instep region and the heel portion is fixedly attached to the upper body 30 (see FIG. 5). The instep side edge portion 32*b* of the belt member 32 has an eyelet hole 32*d* formed therein to insert the shoelace 4 as a fastening member of the shoe 1. The eyelet holes 31*d* of the outside upper member 31 and the eyelet holes 32*d* of the belt member 32 have the shoelace 4 inserted thereinto.

A region 10 that is expandable and contractible in the longitudinal direction is provided on the lateral side of the heel portion of the upper body 30 (see FIGS. 1 and 4). The expandable and contractible region 10 is preferably formed in an inverted-triangular shape or a fan shape. The top end of the region 10 extends to the opening portion of the upper body 30. The bottom end B of the region 10 is located in front of the load centerline C of the calcaneus of the foot and below the height h corresponding to 55% of the lateral ankle height H, which is the height from the bottom surface of the upper body to the most protruding point Kc of the lateral ankle of the foot. In other words, the bottom end B of the region 10 is located below the height corresponding to 0.15 L (L: foot length) from the bottom surface of the upper body 30.

The expandable and contractible region 10 is formed of expandable and contractible synthetic fiber such as nylon, polyurethane and the like, or expandable and contractible materials such as rubber. Preferably, the region 10 is formed of materials having elongation percentage of 15% or more and 40% or less under the action of tensile load of 10N using the cut-slip method provided in JIS (Japanese Industrial Standards) 1018. The reason of adopting elongation percentage of 15% or more is that in the case of 15% or less the amount of contraction is so small that the region cannot absorb a slack of the opening portion at the time of a heel impact on the ground and thus the opening portion opens. Also, the reason of adopting elongation percentage of 40% or less is for the manufacturing purposes, that is, in the case of 40% or more it becomes hard to manufacture the shoe.

The upper body 30 has a tongue portion 7 at the instep portion. For example, the lateral side edge portion 7*a* of the tongue portion 7 is separated from the upper body 30 (see FIG. 4). The lateral side edge portion 7*a* is preferably coupled to the upper body 30 via the expandable and contractible materials such as an expandable and contractible belt (not shown).

When wearing the shoe the shoelace 4 is fastened and then the upper body 30 presses against the calcaneus and talus T of the shoe wearer's foot through the outside upper member 31. Thereby, the heel portion of the foot can be securely supported and a fit of the upper structure relative to the heel portion can be ensured.

At the time of a heel impact on the ground during running, the bottom portion of the upper body 30 is going to elongate in the longitudinal direction and the top portion of the upper body 30 is going to contract in the longitudinal direction in accordance with deformation of the sole heel portion. At this juncture, since there is provided the region 10 expandable and contractible in the longitudinal direction and extending to the opening portion on the lateral side of the heel portion of the upper body 30, the top portion of the upper body 30 can contract in the longitudinal direction and thereby the top portion of the upper body 30 will not expand laterally, thus preventing the opening portion from causing a slack. Also, in this case, since the lateral side edge portion 7*a* of the tongue portion 7 is coupled to the upper body 30 through the expandable and contractible member, the opening portion of the top portion of the upper body 30 can be prevented from opening. As a result, at the time of heel impact on the ground, the opening portion will not open widely and thus a fit of the heel portion of the shoe relative to the heel portion of the foot can be enhanced.

In this case, since the bottom end B of the region 10 is located in front of the load centerline C of the calcaneus of the foot, when impacting the ground on the heel the upper body 30 has enough area for holding the calcaneus of the foot (see FIG. 4). Thereby, a fit of the upper body 30 relative to the heel portion of the foot is not hindered by the region 10 and the upper body 30 can thus secure an area large enough for holding the calcaneus of the foot. Also, in this case, the bottom end B of the region 10 is located below the height h corresponding to 55% of the lateral ankle height H, which is the height from the bottom surface of the upper body 30 to the most protruding point Kc of the lateral ankle (see FIG. 4). Thereby, an adequate space for the region 10 to expand and contract in the longitudinal direction can be secured, thus preventing the opening portion of the top portion of the upper body 30 from causing a great slack at the time of heel impact on the ground.

Then, during the foot flat moment (i.e. the moment of the entire sole contact with the ground) of the shoe to the push off motion of the foot, the load is going to move forwardly (or toward the toe side), but at this juncture the outside upper member 31 presses against the calcaneus and talus T of the foot through the upper body 30 due to tightening of the shoelace 4. Thereby, the foot is prevented from moving forwardly and a fit relative to the heel portion of the foot is maintained. Moreover, in this case, since the outside upper member 31 will not tighten the ankle of the shoe wearer excessively, a free motion of the ankle during running will not be hindered.

In this embodiment, the heel portion of the upper has a two-layered structure composed of the upper body 30 and the outside upper member 31, and the upper body 30 and the outside upper member 31 function independently from each other, that is, at the time of the heel impact on the ground the upper body 30 acts to prevent the opening portion from opening and during the foot flat moment to the push off motion of the foot the outside upper member 31 acts to prevent the foot from moving forwardly. In such a manner, during the heel impact on the ground to the push off motion of the foot a fit of the heel portion of the shoe can be improved without impeding a free motion of the ankle.

Preferably, the expandable and contractible region 10 of the upper body 30 has an elastic elongation when the shoe wearer wears the shoe. In this case, when the top portion of the upper body 30 is going to contract in the longitudinal direction at the time of the heel impact on the ground, the region 10 can contract easily because resilient force has been acting onto the region 10 of the upper body 30 from the beginning to return to the original state, thereby securely preventing the opening portion of the top portion of the upper body 30 from opening.

In the above-mentioned embodiment, an example was shown where the region 10 and the outside upper member 31 are provided on the lateral side of the shoe, and in this case, an upper structure can be attained that is suitable for an athlete who habitually impacts the ground on the heel lateral side of the shoe.

Figure 8:
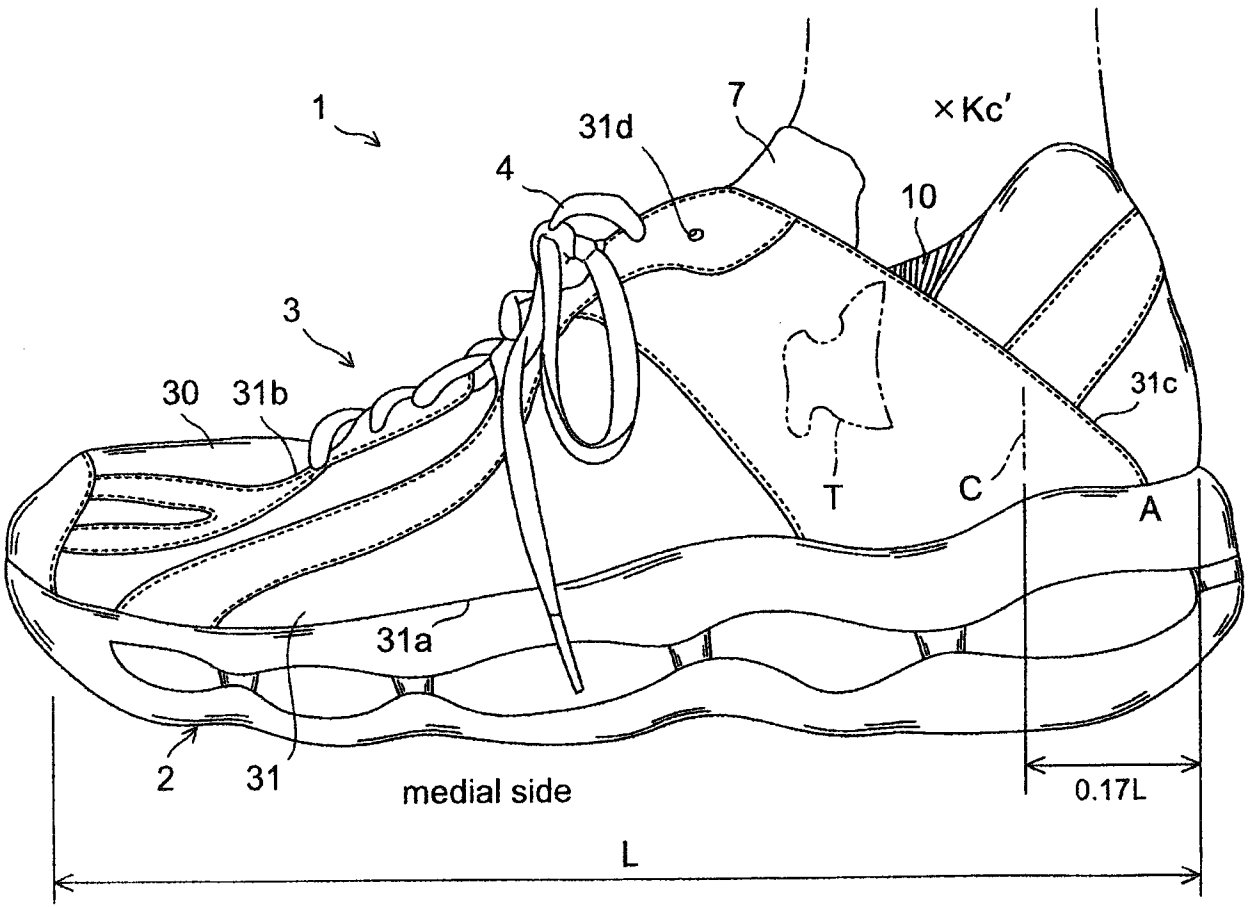
FIG. 8 is a medial side view of a shoe according to another embodiment of the present invention, in which the outside upper member overlaps the outside of the upper body on the medial side of the shoe.
Figure 9:
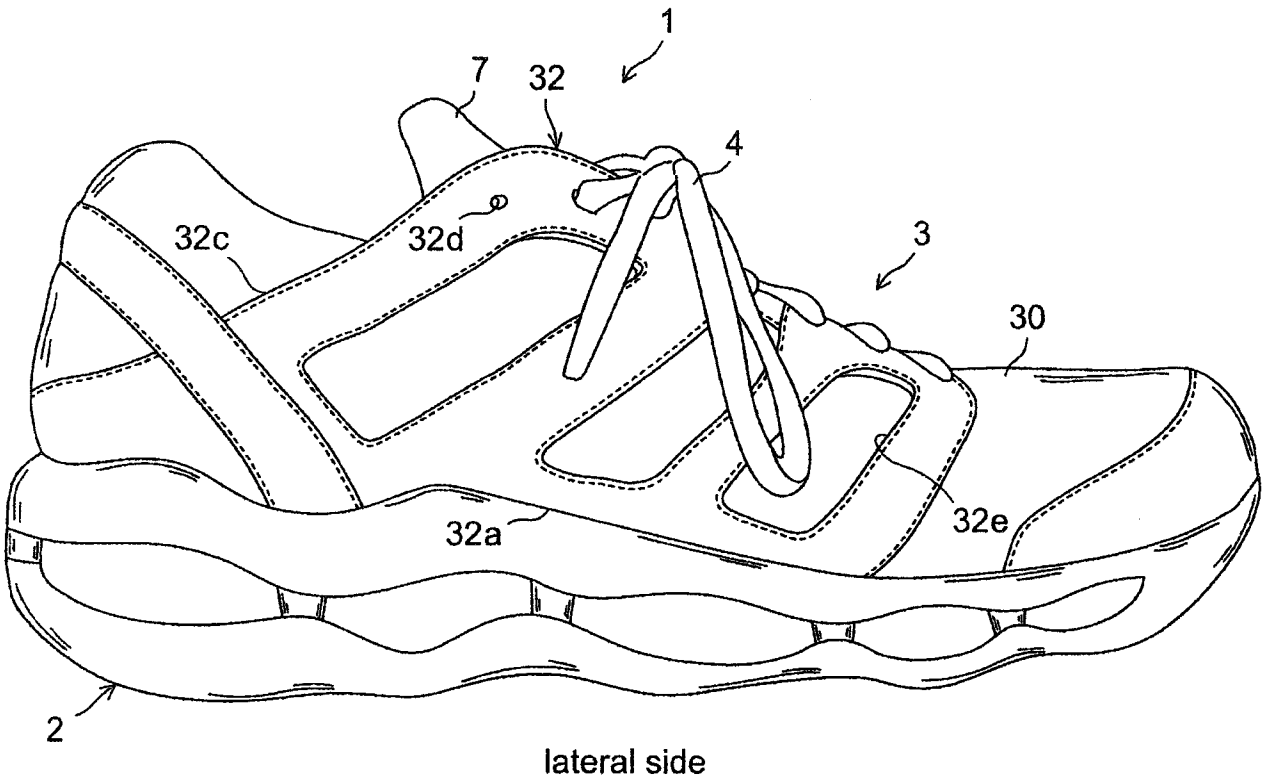
FIG. 9 is a lateral side view of the shoe of FIG. 8.

The present invention can also be applied to the upper structure where the expandable and contractible region is provided on the medial side of the heel portion of the upper body and the outside upper member is overlapped with the upper body on the medial side of the shoe, as shown in FIGS. 8 and 9. The same reference numbers are used for corresponding elements as in the embodiment discussed above. In this case, the bottom end of the expandable and contractible region is located below the height corresponding to 550 of the medial ankle height, which is the height from the bottom surface of the upper body to the most protruding point Kc' of the medial ankle of the foot. More preferably, the bottom end of the expandable and contractible region is located below the height corresponding to 0.15 L (L: foot length) from the bottom surface of the upper body. In this case, an upper structure can be attained suitable for an athlete who habitually impacts the ground on the heel medial side of the shoe.

Figure 10:
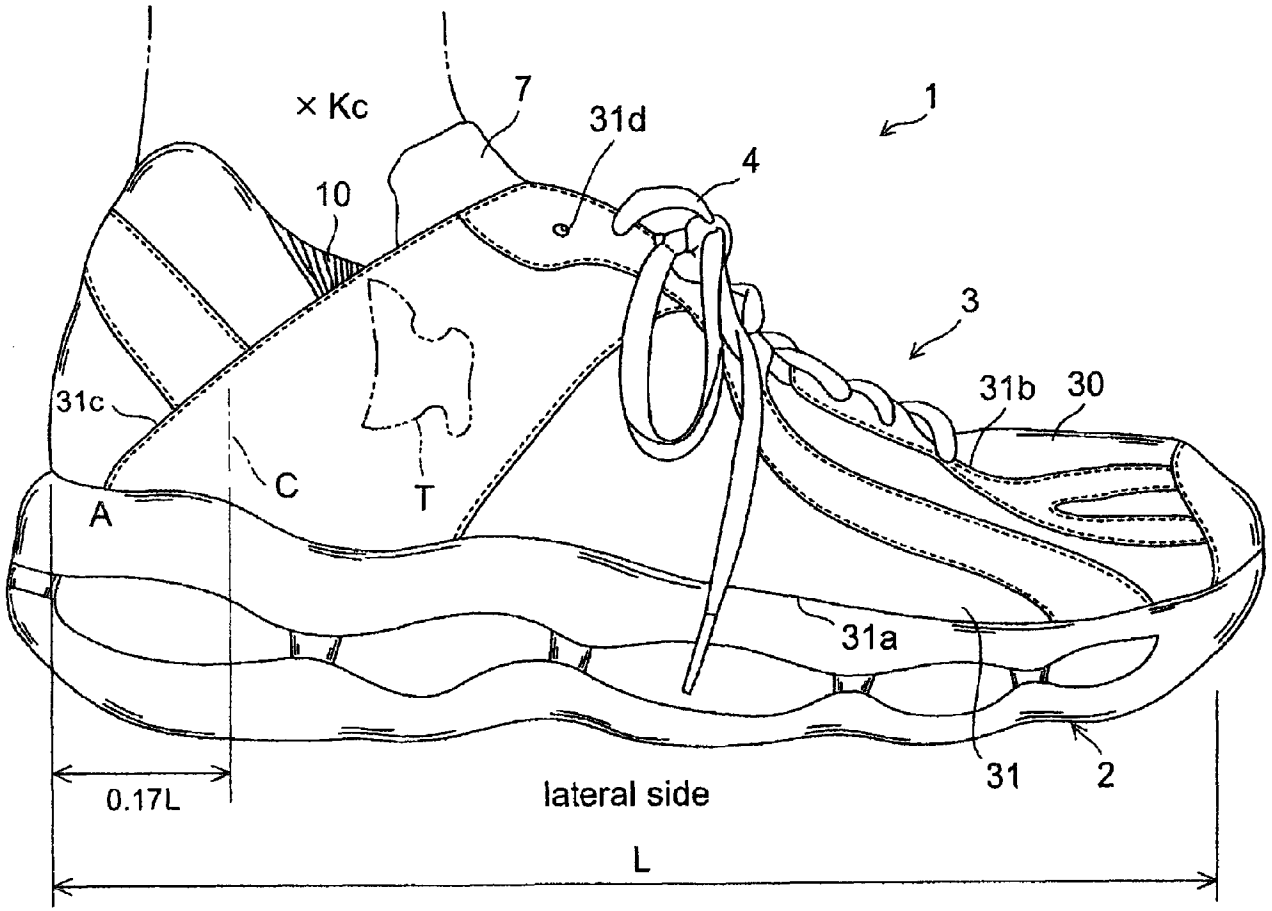
FIG. 10 is a lateral side view of a shoe according to another embodiment of the present invention, in which the outside upper member overlaps the outside of the upper body on both the lateral side and the medial side of the shoe.
Figure 11:
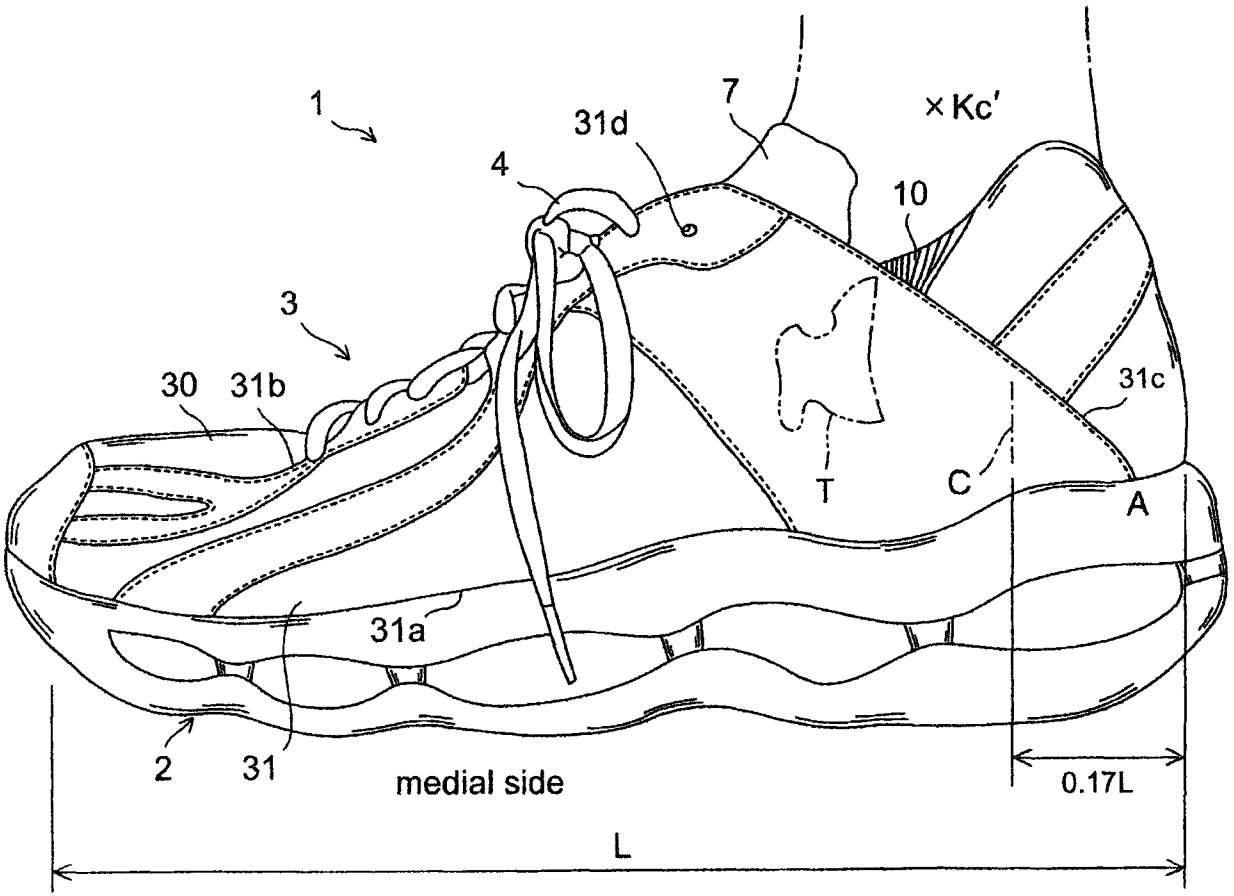
FIG. 11 is a medial side view of the shoe of FIG. 10.

Alternatively, the expandable and contractible region and the outside upper member may be provided on both the lateral side the medial side of the shoe, as shown in FIGS. 10 and 11. The same reference numbers are used for corresponding elements as in the embodiments discussed above. In this case, the bottom end of the expandable and contractible region on the lateral side is located below the height corresponding to 55% of the lateral ankle height of the foot and the bottom end of the expandable and contractible region on the medial side is located below the height corresponding to 55% of the medial ankle height of the foot.

Figure 7:
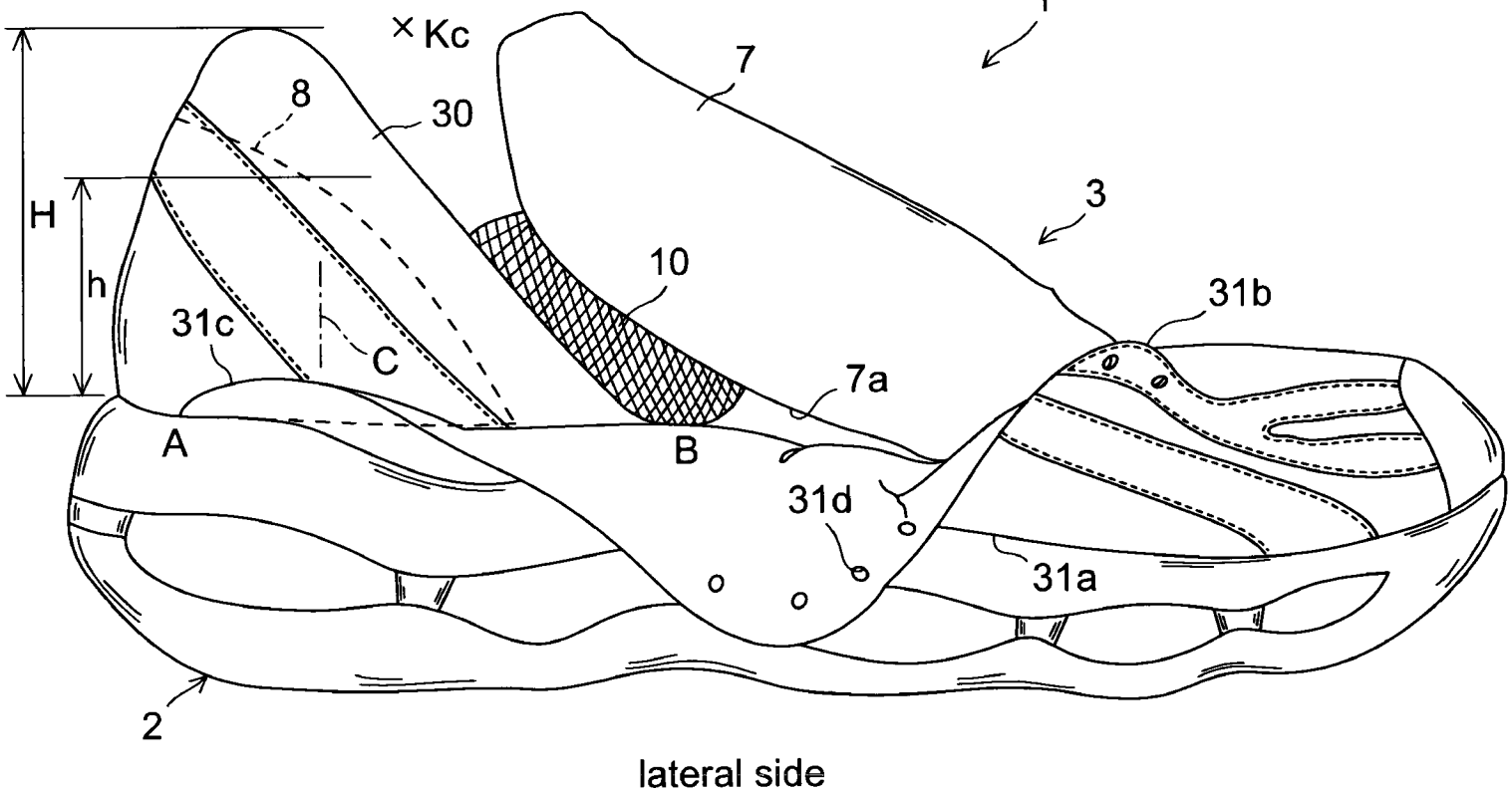
FIG. 7 is a lateral side view of the shoe employing the upper structure according to another embodiment of the present invention, corresponding to FIG. 4 of the above-mentioned embodiment.

FIG. 7 is a lateral side view of a shoe employing an upper structure according to another embodiment of the present invention. In FIG. 7, like reference numbers indicate identical or functionally similar elements.

The example shown in FIG. 7 differs from the above-mentioned embodiment of FIGS. 1 to 6 in that the upper body 30 is not provided in the midfoot region of the shoe 1 and the lateral side edge portion 7*a* of the tongue portion 7 extends sideward toward the vicinity of the sole. The heel portion of the upper body 30 and the lateral side edge portion 7*a* of the tongue 7 are interconnected by the expandable and contractible region 10 extending therebetween. The bottom end B of the region 10 is disposed in the vicinity of the sole upper surface.

In this case, when the heel upper portion of the upper body 30 is going to contract in the longitudinal direction due to deformation of the sole heel portion at the time of heel impact on the ground, the opening portion of the heel upper portion of the upper body 30 is easy to contract thereby more securely preventing the opening portion of the upper body 30 from causing a slack.

In each of the embodiments, the rigidity of the upper body 30 may be higher than the rigidity of the outside upper member 31. This can be achieved by the method such as utilizing a counter that has been resin-formed in a heel shape. In this case, an upper structure can be attained where the upper body 30 displays a superior supportability for the foot.

Alternatively, the rigidity of the upper body 30 may be lower than the rigidity of the outside upper member 31. This can be achieved by the method such as utilizing a counter formed of rubber or the like. In this case, an upper structure can be attained where the upper body displays superior follow-up properties relative to the foot. Also, in this case, wear feeling for the foot at a standstill can be improved.

At the heel portion of the shoe 1, a heel counter member 8 may be provided to improve the supportability of the heel portion of the shoe (see FIG. 4). Preferably, the heel counter member 8 does not overlap the expandable and contractible region 10 of the upper body 30, thereby preventing the region 10 from hindering the function of the heel counter member 8.

The upper structure of the present invention is suitable for a running shoe, but the present invention is also applicable to a walking shoe, tennis shoe, basketball shoe and the like. Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

The invention claimed is:

1. A shoe to be worn on a person's foot, which has an instep, a heel and an ankle, wherein said shoe comprises a sole, an upper structure and a releasable and adjustable fastening member, and wherein said upper structure comprises:

an upper body heel portion that is fixedly attached to said sole at a bottom of said upper body heel portion and extends upwardly from said sole, and that is positioned and configured to cover at least some of the heel of the foot, an upper body instep portion that is fixedly attached to said sole at a bottom of said upper body instep portion and extends upwardly from said sole, and that is positioned and configured to cover at least some of the instep of the foot, with a gap between said upper body heel portion and said upper body instep portion along an upper opening of said upper structure on at least a first side being a lateral side or a medial side of said shoe, a tongue partially overlapping and extending upwardly and rearwardly from said upper body instep portion along said gap, at least one extendable region that is respectively interposed on at least said first side of said shoe between said upper body heel portion and said tongue, such that said extendable region interconnects said tongue and said upper body heel portion across said gap, and such that said upper opening is bounded by said upper body heel portion, said extendable region and said tongue, wherein said extendable region is elastically extendable and contractible in a longitudinal direction of said shoe, and an outside upper member that overlaps outwardly on at least some of said upper body heel portion, at least some of said upper body instep portion, and at least some of said tongue, and that is bounded by at least a bottom edge portion, a rear edge portion and an instep edge portion, wherein said bottom edge portion is fixedly attached respectively to said bottom of said upper body heel portion and said upper body instep portion, wherein said instep edge portion is separate from and extends onto said upper body instep portion and said tongue, wherein said instep edge portion is connected to and adjustably and releasably secured by said fastening member of said shoe, and wherein said rear edge portion is provided separate from said upper body heel portion such that said rear edge portion and said instep edge portion of said outside upper member can be pulled outwardly away from said upper body heel portion, said upper body instep portion and said tongue when said fastening member is released.

2. The shoe according to claim 1, wherein said upper body heel portion and said upper body instep portion are not provided at a midfoot region of said shoe, said gap is provided at said midfoot region of said shoe, and a bottom end of said gap extends proximate to an upper extent of said sole.

3. The shoe according to claim 2, wherein said extendable region covers said gap between said upper body heel portion and a lateral edge of said tongue and up to said upper opening, and a bottom end of said extendable region is disposed proximate to an upper extent of said sole at a bottom end of said gap.

4. The shoe according to claim 1, wherein said extendable region has an elongated strip shape between substantially-parallel mutually-facing edges of said upper body heel portion and said tongue respectively.

5. The shoe according to claim 1, wherein said extendable region slopes obliquely rearwardly and upwardly from a bottom end to a top end thereof.

6. The shoe according to claim 1, wherein:

the heel of the person's foot includes a calcaneus, the ankle of the person's foot includes a talus, and a calcaneus load centerline is defined as extending along a centerline of loading of the calcaneus when the person stands on the foot, an ankle height is defined as a height, above said bottom of said upper body heel portion, of a point of maximum lateral or medial protrusion of the ankle of the person's foot on said first side, a bottom end of said extendable region is located forwardly of the calcaneus load centerline and below a height corresponding to 55% of the ankle height, and said outside upper member covers the talus of the person's foot on at least said first side, a rear end of said bottom edge portion is located rearwardly of the calcaneus load centerline, and said rear edge portion extends rearwardly of the talus.

7. The shoe according to claim 1, configured, arranged and adapted so that during a heel impact of a heel of said sole on a ground surface said extendable region will contract in the longitudinal direction and prevent said upper opening of said upper structure from opening away from the foot and causing a slack, and so that during a foot-flat moment of a midfoot of said sole contacting the ground surface and during a toe push-off of a toe of said sole from the ground surface a tension of said fastening member will pull said outside upper member and therewith said upper body heel portion, said upper body instep portion, said extendable region and said tongue against the foot and prevent the foot from moving forwardly in said shoe.

8. The shoe according to claim 1, wherein a front end portion of said outside upper member is fixedly attached to said upper body instep portion.

9. The shoe according to claim 1, wherein said rear edge portion of said outside upper member meets said bottom edge portion of said outside upper member and forms an apex at a rear end of said bottom edge portion, said rear edge portion slopes diagonally forwardly and upwardly over a lower forward portion of said upper body heel portion, and a remainder of said upper body heel portion other than said lower forward portion remains uncovered by said outside upper member.

10. The shoe according to claim 9, wherein said rear end of said bottom edge portion of said outside upper member is located forwardly spaced away from a rear end of said upper body heel portion.

11. The shoe according to claim 1, wherein the ankle of the foot includes a talus, and said extendable region is at least partly located on the talus of the foot.

12. The shoe according to claim 1, wherein said outside upper member outwardly covers only a portion of said extendable region, and said rear edge portion of said outside upper member extends diagonally forwardly and upwardly across said extendable region.

13. The shoe according to claim 1, wherein said extendable region exhibits an elongation from 15% to 40%.

14. The shoe according to claim 1, wherein a bottom end of said extendable region is located below a height corresponding to 0.15 L upwardly from said bottom of said upper body heel portion, wherein L is a length corresponding to a shoe size of said shoe.

15. The shoe according to claim 1, wherein said extendable region is dimensioned so that said extendable region is in an elastically elongated state under elastic tension when said shoe is worn on the person's foot.

16. The shoe according to claim 1, wherein the heel of the person's foot includes a calcaneus, wherein a calcaneus load centerline is defined as extending along a centerline of loading of the calcaneus when the person stands on the foot, and wherein said shoe is configured so that the calcaneus load centerline is located at a position 0.17 L forwardly of a rear end of said upper body heel portion, wherein L is a length corresponding to a shoe size of said shoe.

17. The shoe according to claim 1, wherein said upper body heel portion and said upper body instep portion has a higher rigidity than said outside upper member.

18. The shoe according to claim 1, wherein said outside upper member has a higher rigidity than said upper body heel portion and said upper body instep portion.

19. The shoe according to claim 1, further comprising a heel counter member arranged in said upper body heel portion, wherein said heel counter member is configured and arranged rearwardly of said extendable region so that said extendable region does not overlap said heel counter member.

20. The shoe according to claim 1, further comprising a heel strap that is arranged outwardly on said upper body heel portion, and that extends diagonally upwardly and rearwardly from said bottom edge portion of said outside upper member so that said outside upper member overlaps on a lower forward portion of said heel strap.

21. The shoe according to claim 20, wherein a forward end of said heel strap is located rearwardly of a bottom end of said extendable region of said upper body.

22. The shoe according to claim 20, wherein said heel strap passes rearwardly of and below said extendable region and does not overlap on said extendable region.

23. The shoe according to claim 20, wherein said heel strap extends substantially parallel to a rear edge of said extendable region, and substantially perpendicular to said rear edge portion of said outside upper member.

24. The shoe according to claim 1, wherein said first side is said lateral side of said shoe.

25. The shoe according to claim 24, wherein said outside upper member and said extendable region are provided on only said first side of said shoe.

26. The shoe according to claim 1, wherein said first side is said medial side of said shoe.

27. The shoe according to claim 26, wherein said outside upper member and said extendable region are provided on only said first side of said shoe.

28. The shoe according to claim 26, wherein said outside upper member and said extendable region are provided respectively on both said first side and a second side being said lateral side of said shoe.

* * * * *

UNITED STATES PATENT AND TRADEMARK OFFICE

CERTIFICATE OF CORRECTION

PATENT NO. : 8,490,298 B2
APPLICATION NO. : 13/240384
DATED : July 23, 2013
INVENTOR(S) : Natsuki Sato et al.

It is certified that error appears in the above-identified patent and that said Letters Patent is hereby corrected as shown below:

On the Title Page,
Item [75], Inventors:
replace "Kawanishi" by --Kawanishi-shi--;
replace "Nishinomiya" by --Nishinomiya-shi--;

In the Specifications
Column 1,
Line 8, after "2007,", replace "issue" by --issued--;

Column 7,
Line 46, after "corresponding to", replace "550" by --55%--;
Line 57, after "side" (first occurrence), insert --and--.

Signed and Sealed this
Twenty-fifth Day of March, 2014

Michelle K. Lee

Michelle K. Lee
*Deputy Director of the United States Patent and Trademark Office*